US005720332A

United States Patent [19]

Nachreiner

[11] Patent Number: 5,720,332

[45] Date of Patent: Feb. 24, 1998

[54] IMPACT PANEL ASSEMBLY FOR USE WITH A SECTIONAL OVERHEAD DOOR

[76] Inventor: Kenneth E. Nachreiner, 503 Garden Cir., Streamwood, Ill. 60107

[21] Appl. No.: 693,777

[22] Filed: Aug. 7, 1996

[51] Int. Cl.[6] ..... E05D 15/16

[52] U.S. Cl. ..... 160/205; 160/201

[58] Field of Search ..... 160/201, 205, 160/267.1, 271, 274, 275; 52/311.1; 16/74

[56] References Cited

U.S. PATENT DOCUMENTS

| | | | |
|---|---|---|---|
| 3,928,889 | 12/1975 | Wartian | 16/74 |
| 4,149,295 | 4/1979 | Owen . | |
| 5,163,494 | 11/1992 | MacNeil et al. | 160/205 X |
| 5,168,915 | 12/1992 | Lafleur | 160/201 X |
| 5,535,805 | 7/1996 | Kellogg et al. | 160/201 |
| 5,584,333 | 12/1996 | Torchetti et al. | 160/201 |

*Primary Examiner*—Blair Johnson
*Attorney, Agent, or Firm*—Meroni & Meroni

[57] ABSTRACT

An impact panel assembly is provided for use with a sectional overhead door. The assembly includes a rigid impact panel structure. A frame structure is pivotally connected with the impact panel structure for supporting the impact panel structure and allowing the impact panel structure to pivot up to 90° from the frame structure from a closed position with the impact panel structure generally vertically oriented to an impacted position with a lower horizontally extending portion of the impact panel structure being outwardly extendible. A resilient member is operatively connected between the frame structure and the impact panel structure for automatically and resiliently moving the impact panel assembly from the impacted position to the closed position.

27 Claims, 3 Drawing Sheets

IMPACT PANEL ASSEMBLY FOR USE WITH A SECTIONAL OVERHEAD DOOR

BACKGROUND OF THE INVENTION

1. Field of the Invention

The present invention relates generally to sectional overhead doors. More particularly, the invention pertains to an impact panel assembly for use with sectional overhead doors.

2. Description of the Prior Art

Sectional overhead doors, such as those employed in warehouses and often referred to as dock doors, are generally comprised of a plurality of panels pivotally connected to one another by hinges for extension transversely across a door opening. Vertical sides of the panels include roller assemblies for rotational engagement within guide trackways to provide guided movement of the door within the guide trackways from an open position to a closed position.

In use, bottom portions of the sectional overhead doors are commonly damaged by material handling equipment. Lift tracks, for example, accidentally pushing pallets or their lifting forks into such a door causes expensive damage to the door. The bottom panel portion of the damaged door is then required to be replaced or repaired which also can result in possible downtime to the dock position of that door.

As will be described in greater detail hereinafter, the impact panel assembly and sectional overhead door assembly of the present invention differ from those previously proposed and employs a number of novel features that render it highly advantageous over the prior art.

SUMMARY OF THE INVENTION

Accordingly, it is an object of this invention to provide an impact resistant panel assembly for use with a sectional overhead door which swings outwardly upon the application of an impact force or object thereon and automatically returns to its original position upon removal of the impacting force or object.

Another object of this invention is to provide an impact panel assembly that is easy to install, can be retrofitted to replace the bottom panel portions of existing sectional overhead doors, and is adapted to connect with sectional overhead doors of varied design.

Still another object of this invention is to provide an impact panel assembly that is strong to withstand high impact forces while at the same time has a weight approximately equal to that of a previously existing bottom panel portion of the sectional overhead door to provide a balanced door.

Yet another object of this invention is to provide an impact panel assembly that can pivot up to 90° from a closed position and can be locked in the closed position for added security during nonuse times.

To achieve the foregoing and other objectives, and in accordance with the purposes of the present invention an impact panel assembly is provided for use with a sectional overhead door. The assembly includes a rigid impact panel structure. A frame structure is pivotally connected with the impact panel structure for supporting the impact panel structure and allowing the impact panel structure to pivot from the frame structure from a closed position with the impact panel structure generally vertically oriented to an impacted position with a lower horizontally extending portion of the impact panel structure being outwardly extendible. A resilient member is operatively connected between the frame structure and the impact panel structure for automatically and resiliently moving the impact panel assembly from the impacted position to the closed position.

In accordance with an aspect of the invention, an impact panel structure is provided which includes a rigid internal support frame extending substantially around outer side portions of the impact panel structure. The internal support frame has an outer side and an inner side. An outer skin is connected to the outer side of the internal support frame. An inner skin formed of rigid high impact strength material is secured in pressing engagement to the inner side of the internal support frame by a plurality of thermal expansion type fasteners.

Other objects, features and advantages of the invention will become more readily apparent upon reference to the following description when taken in conjunction with the accompanying drawings, which drawings illustrate several embodiments of the invention.

DETAILED DESCRIPTION OF THE PREFERRED EMBODIMENT

Figure 1:
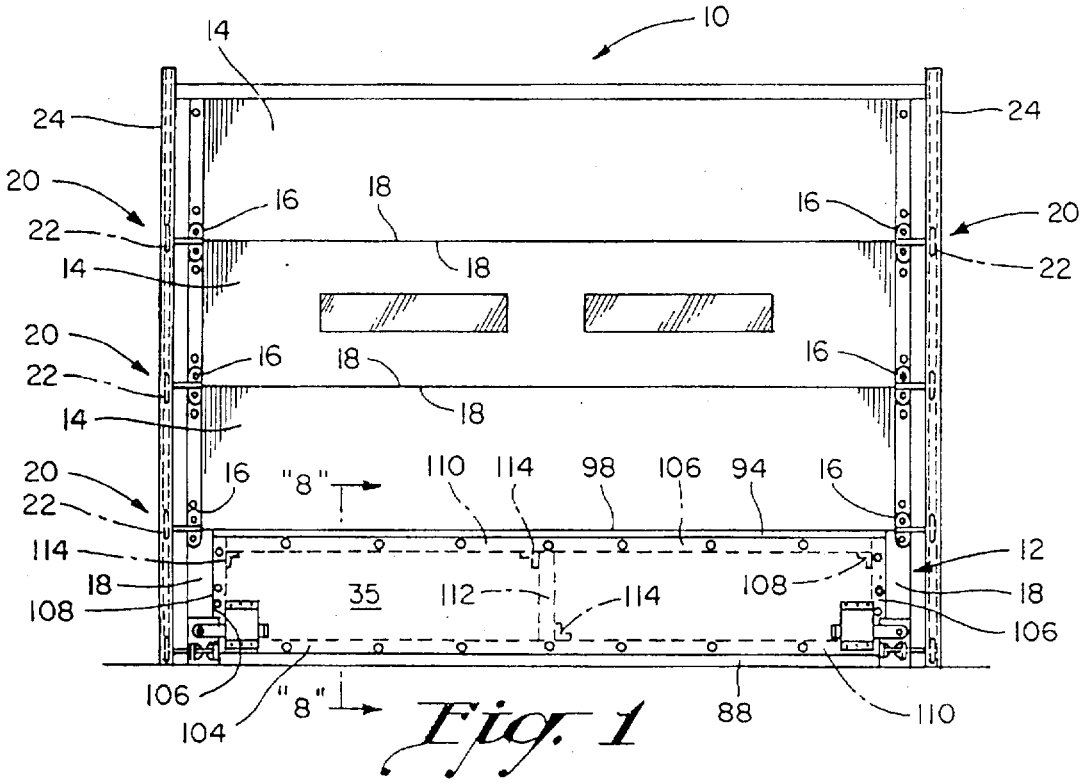
FIG. 1 is an inside elevation view of a sectional overhead door assembly of the present invention with an impact panel structure in a closed position.

Referring now to the drawings, an impact resistant sectional overhead door or assembly 10 is illustrated in FIG. 1 having an impact panel assembly 12 secured thereto.

The sectional overhead door 10 is generally formed of metal or wood and includes a plurality of adjacent door panels 14 lying within a common place and oriented in stacked parallel abutting fashion with respect to one another. A plurality of hinges 16 are connected to facing horizontal edge portions 18 of adjacent panels 14 for providing flexible connection therebetween.

A plurality of roller assemblies 20 of conventional design are connected to the door panels 14. Each roller assembly 20 has a roller 22 rotationally engaging one of the vertical guide tracks 24 for guiding the movement of the door assembly 10 on the tracks. In a known and commonly used configuration, the hinge 16 and roller assembly 20 are interconnected with one another in a one piece design. The vertical guide tracks 24 are of conventional design and are typically formed of galvanized steel. The door assembly 10 is movable along the tracks 24 from a closed position as shown in FIG. 1 to an open position with the door assembly extended upwardly with assistance by a conventional counterbalance mechanism (not shown), such as torsion spring counterbalance mechanism.

In use, bottom portions or panels of conventional sectional overhead doors are commonly damaged by material handling equipment. This damaged bottom panel can be replaced with the bottom impact panel assembly 12 of the present invention. The impact panel assembly 12 is connected to an adjacent panel 14 by hinges 16 on opposite sides 18 of the assembly 12.

Figure 2:
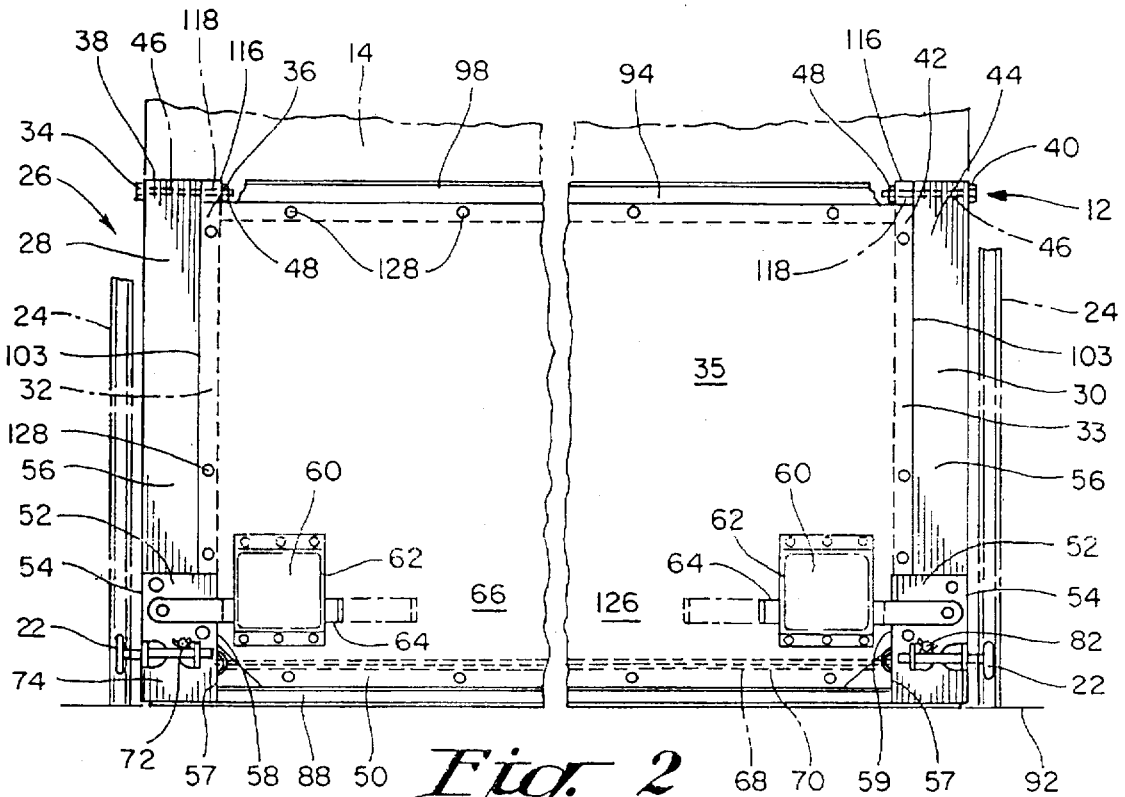
FIG. 2 is an enlarged elevation view of the impact panel apparatus of the present invention with some parts broken away.
Figure 3:
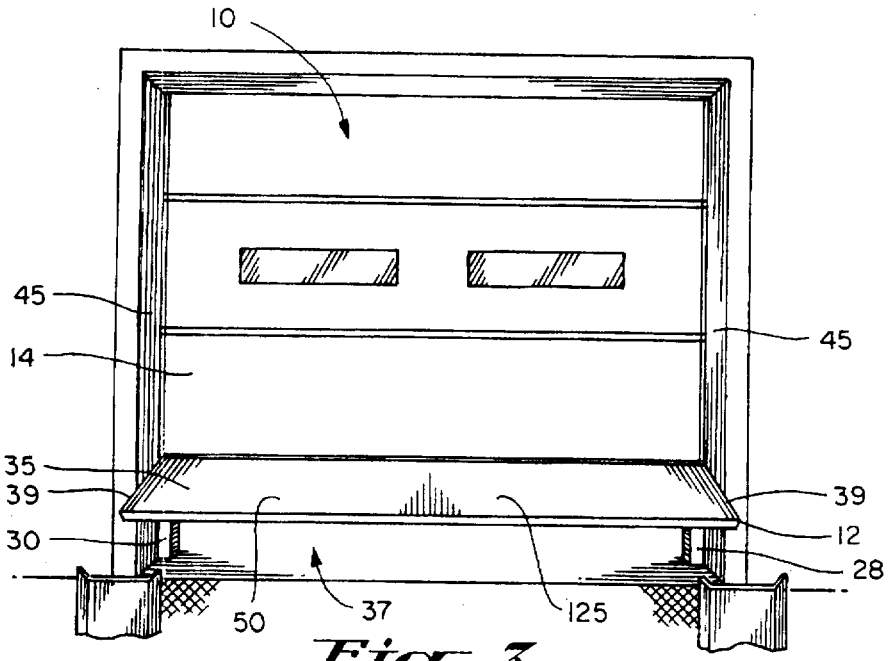
FIG. 3 is an outside perspective view of the sectional overhead door assembly of the present invention with the impact panel structure in an impacted position.

Referring to FIG. 2, a frame structure 26 includes a first upright frame member or stile 28 and a second upright frame member or stile 30 disposed in a spaced apart relationship from one another and adjacent to opposite vertical sides 32,33 of an impact panel structure 35. A first pivot member or bolt 34 is provided for pivotally connecting a first upper end portion 36 of the impact panel structure 35 to a top portion 38 of the first upright frame member 28. A second pivot member or bolt 40 is provided for pivotally connecting a second upper end portion 42 of the impact panel structure 35 to a top portion 44 of the second upright frame member 30. As shown in the drawings, the first and second pivot members 34,40 extend horizontally from opposite vertical sides 32,33 of the impact panel structure 35 to upper portions of respective upright frame members 28,30. It should also be appreciated that the frame members 28,30 extend inwardly of the door opening 37 so that the impact panel structure 35 has a width reduced in comparison to the adjacent panels 14 so that edges 39 of the structure 35 are able to extend past door jams 45 (FIG. 3).

Figure 4:
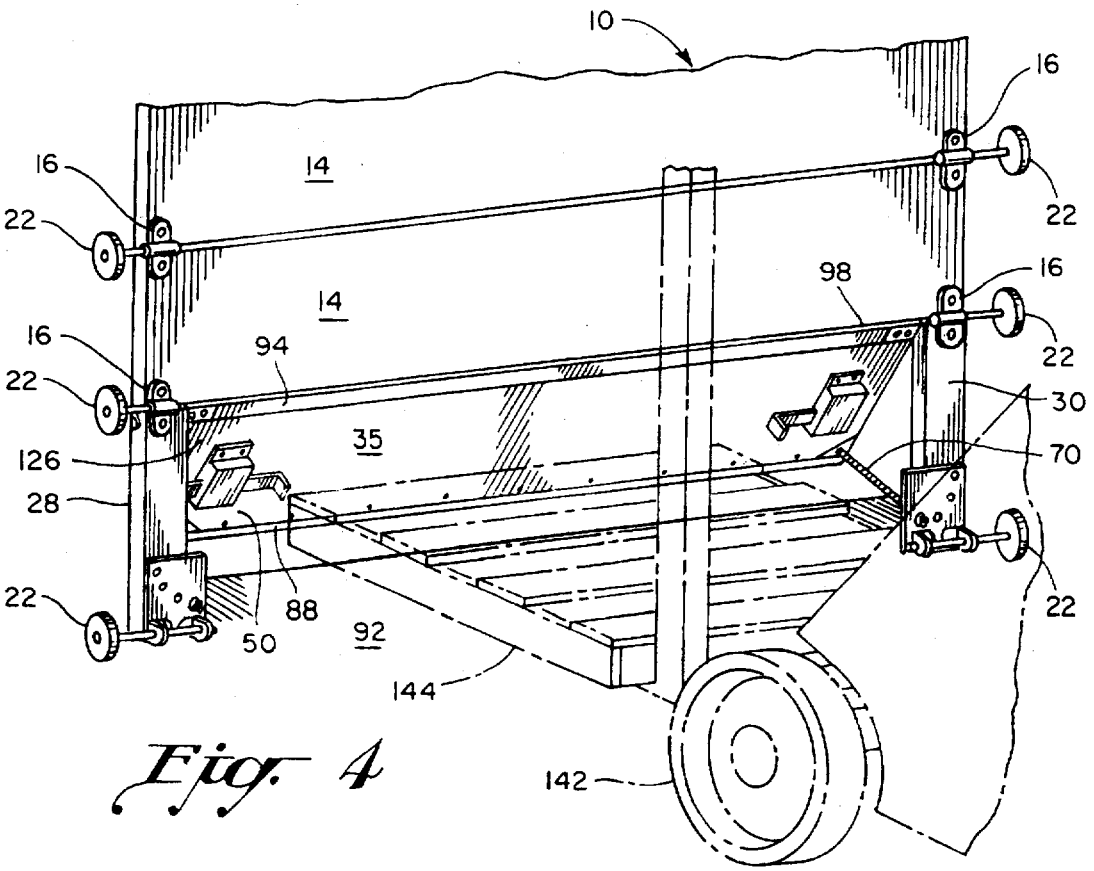
FIG. 4 is a partial inside perspective view of the present invention.
Figure 5:
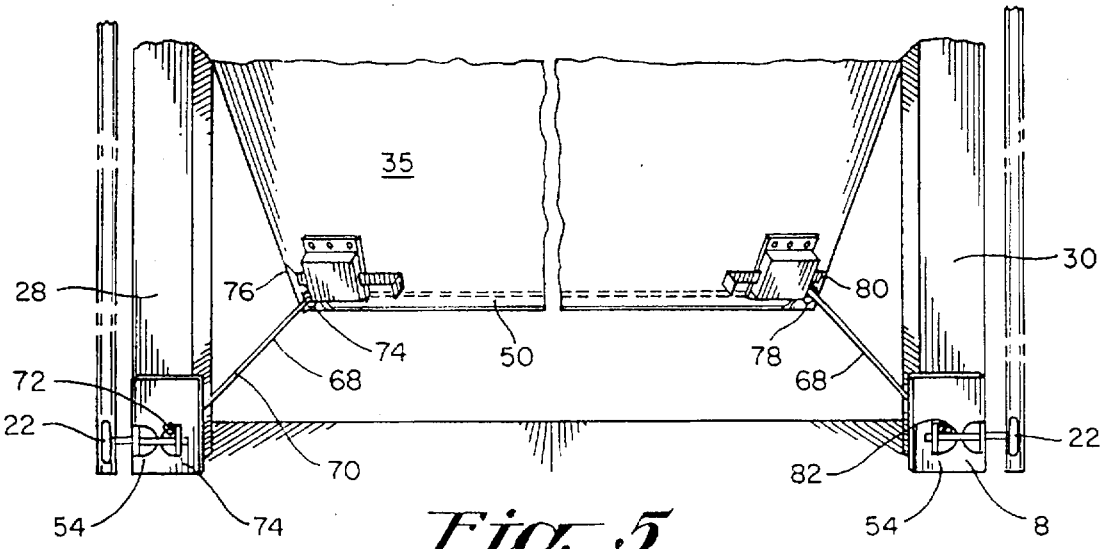
FIG. 5 is an enlarged inside perspective view of the impact panel structure in an outwardly extended impacted position.

In FIG. 2, the hinges 16 have been removed in order to illustrate the position of the bolts 34,40. The bolts 34,40 extend horizontally through holes 46 in the respective frame members 28,30 and are secured with a locking nut 48. The bolts 34,40 provide for pivotal movement of the impact panel structure 35 from a closed position, as shown in FIGS. 1 and 2, with the impact panel structure 35 generally coplanar with the first and second upright frame members 28,30 to an impacted position, as shown in FIGS. 3–5, with a lower horizontally extending portion 50 of the impact panel structure 35 being outwardly extendible up to 90°. It is significant to note that the extendibility of the impact panel structure 35 up to 90° is an important advantage over prior art devices which have a limited range of motion, such as 0° to 15°, and are subject to falling apart or damage if this limited range is exceeded.

A stop 52 is operatively connected to each of the first and second upright frame members 28, 30 to prevent the impact panel structure 35 from pivoting inwardly from the closed position. Preferably, the stop 52 comprises a plate 54 connected to an inner surface 56 of each of the frame members 28,30 with an edge portion 57 of the plate 54 extending laterally inward for stopping engagement with respective first and second lower edge portions 58,59.

Figure 6:
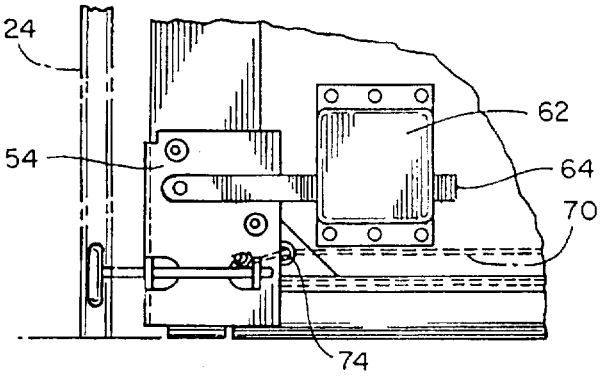
FIG. 6 is an enlarged fragmentary inside view of a lower portion of the impact panel assembly in a locked position.

A locking structure 60 is provided for releasably locking the impact panel structure 35 in the closed position for added security during nonoperational times. In a preferred embodiment shown in FIGS. 2 and 6, the locking structure 60 is a slide lock assembly 62 of conventional design having a spring activated lock bar 64. The slide lock assembly 62 is secured to an inner side 66 of the impact panel structure 35. Slide lock assemblies 62 are secured on opposite vertical sides 32,33 of the impact panel structure with the lock bar 64 being manually movable from an unlocked position (FIG. 5) to a locked position (FIG. 2) with the lock bar 64 in locking engagement with a corresponding frame member 28,30.

Referring to FIGS. 2 and 5, a resilient member or portion 68 is operatively connected to the impact panel structure 35 for automatically and resiliently moving the impact panel structure 35 from the impacted position to the closed position upon removal of an impact force being applied thereto. In the preferred embodiment shown, the resilient member is formed of an elastic cord 70, such an industrial type nylon bungee cord, having a first end 72 secured to a bottom portion 74 of the first upright frame member 28 at the plate 54. The elastic cord 70 enters a grommetted opening 74 in a first lower end portion 76 of the impact panel structure 35 and extends through the lower horizontally extending portion 50 of the impact panel structure 35. The elastic cord 70 exits from a grommetted opening 78 in a second lower end portion 80 of the impact panel structure 35 with a second end 82 of the elastic cord 84 being secured to a bottom portion 86 of the second upright frame member 30 at the plate 54. The elastic cord 70 has its ends 72, 82 being secured with tension being applied to the elastic cord 70 when the impact panel structure 35 is in a closed position so that the structure 35 remains in the closed position until an impact force is applied to move the structure 35 outwardly.

Figure 9:
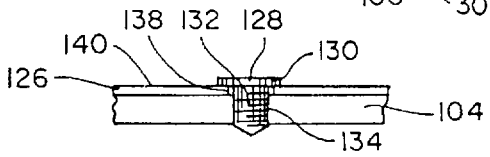
FIG. 9 is a fragmentary sectional view of a thermal expansion fastener.
Figure 8:
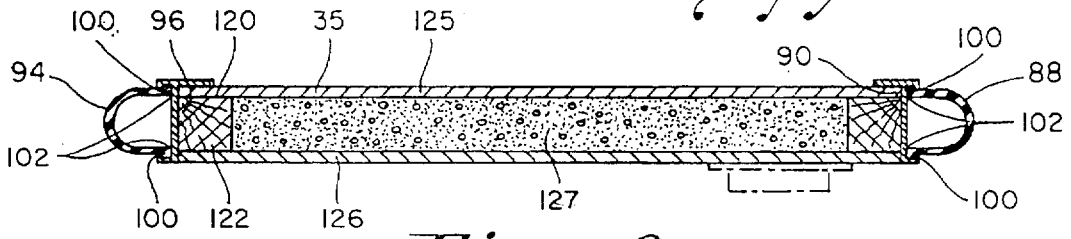
FIG. 8 is a section view of the impact panel assembly taken along line 8—8 of FIG. 1.

Referring to FIGS. 2, 8 and 9, a flexible lower seal 88 is secured to a lower edge portion 90 of the impact panel structure 35 and extends the entire length thereof for positioning in immediate adjacency with a ground surface 92 when the impact panel structure 35 is in the closed position to seal out air, insects and the like. A flexible upper seal 94 is secured to an upper edge portion 96 of the impact panel structure 35 and extends substantially the entire length thereof for positioning in immediate adjacency with a lower edge portion 98 of the adjacent panel 14 when the impact panel structure 35 is in the closed position. It is important to note the upper seal 94 provides a dual function. While it provides a sealing effect similar to the lower seal 88 to keep out air and insects, for example, it also allows the impact panel assembly 14 to be retrofitted to sectional overhead doors of varied design where the lower edge portion 98 of the adjacent panel 14 may vary. The flexible nature of the upper seal 94 allows for automatic adapting of the assembly 14 without the use of special adapters. In the preferred embodiment shown, the seals 88,94 are U-shaped rubber seals having edges 100 engaging raceways 102 of a metal track member secured to and extending along the respective edge portion 90,96. Side seals 103 formed of polypropylene can also be employed.

Figure 7:
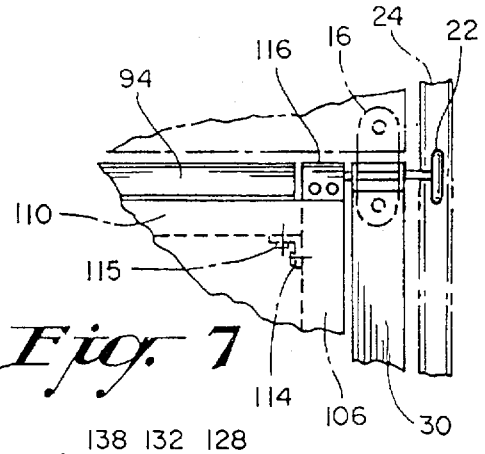
FIG. 7 is an enlarged fragmentary inside view of an upper portion of the impact panel assembly.

Referring to FIG. 1, the impact panel structure 35 includes a rigid internal support frame 104 extending substantially around outer side portions 106 of the impact panel structure 35. The internal support frame 104 is generally rectangular shaped and is formed of vertical side members 108, horizontal side members 110, and a vertical support member 112, all of which are secured to one another by L-shaped brackets 114 connected with rivets or screws 115 (FIG. 7). Upper end portions 116 of the vertical side members 108 extend above the horizontal side member 110 to allow the corresponding bolts 34,40 to extend through holes 118 in the upper end portions 116 to provide the pivotal connection of the structure 35 to the flame members 28,30 previously described.

The support frame 104 as well as the frame structure 26 are preferably formed of square tube shaped pultruded fiberglass material. This material provides water resistant characteristics for use in washdown applications and the weight of this material is lighter than steel or aluminum, which is conventionally used material, so that the entire assembly 14 is able to closely duplicate the weight of a bottom panel that the assembly 14 is replacing. This is an important advantage so that the torsion spring of the counterbalance mechanism is not over stressed. Additionally, this material is strong and well suited for absorbing impacts. The support flame 104 and frame structure 26 are additionally reinforced with high density polyethylene in the end portions which coact with the bolts 34,40.

The internal support frame 104 has an outer side 120 and an inner side 122. An outer skin 125 (FIG. 3) is connected to the outer side 120 of the internal support frame 104. The outer skin 125 is preferably formed of aluminum and assists in security by eliminating the possibility of an intruder cutting through with a knife. An inner skin 126 formed of rigid high impact strength ABS plastic material secured in pressing engagement to the inner side 122 of the internal support frame 104 by a plurality of thermal expansion type fasteners 128. Between the outer skin 125 and inner skin 126 is high density foam 127 which provides additional rigidity.

Referring to FIG. 9, each fastener 128 has an enlarged head 130 and a shaft 132 having a plurality outwardly projecting surfaces or rings 134. The internal support frame 104 has holes 136 sized for receiving the shafts 132 of the fasteners 128 with the outwardly projecting surfaces 134 engaging the holes 136 to secure the fasteners 128 in place. The inner skin 126 has expansion holes 138 for extension of the shafts 132 therethrough. The expansion holes 138 have a diameter greater than that of the holes 136 and are thereby sized to allow the inner skin 126 to remain free of engagement with the shafts 132 the fasteners 128. The enlarged head 130 of each fastener 128 is in pressing engagement with an outer surface 140 of the inner skin 126.

The inner skin 126 formed of ABS plastic has strength characteristics which allow for the impacts from fork lift tracks 142 and pallets 144 (FIG. 4). The ABS plastic is also water resistant for applications, such as in food processing plants, where a user must wash down the loading docks. The nature of ABS plastic involves expansion and contraction as the temperature changes. The use of the thermal expansion fasteners 128 in the manner described above allows for such expansion and contraction without producing warping of the inner skin 126.

Although the invention has been described by reference to some embodiments it is not intended that the novel device be limited thereby, but that modifications thereof are intended to be included as falling within the broad scope and spirit of the foregoing disclosure, the following claims and the appended drawings.

I claim:

1. An impact resistant sectional overhead door assembly movable on parallel tracks comprising:

(a) a plurality of adjacent door panels lying within a common plane and oriented in stacked abutting fashion with respect to one another;

(b) a plurality of hinges connected to facing horizontal edge portions of adjacent door panels for providing flexible connection therebetween;

(c) a plurality of roller assemblies connected to the door panels, each roller assembly having a roller adapted for rotationally engaging one of the tracks for guiding the movement of the door assembly on the tracks; and (d) one of said door panels comprising a bottom impact panel assembly connected to an adjacent door panel by hinges, the bottom impact panel assembly comprising: a rigid impact panel structure; first and second upright frame members pivotally connected to the adjacent door panel and disposed in a spaced apart relationship adjacent opposite vertical sides of the impact panel structure, each of the first and second upright frame members being adapted for extending laterally adjacent to respective tracks and being movable thereon with the impact panel structure, first pivot means for pivotally connecting a first upper end portion of the impact panel structure to a top portion of the first upright frame member, second pivot means for pivotally connecting a second upper end portion of the impact panel structure to a top portion of the second upright frame member, the first and second pivot means each including a horizontally extending pivot member disposed on a corresponding one of the opposite vertical sides of the impact panel structure providing pivotal movement of the impact panel structure from a closed position with the impact panel structure generally coplanar with the first and second upright frame members to an impacted position with a lower horizontally extending portion of the impact panel structure being outwardly extendible, and resilience-producing means operatively connected to the impact panel structure for automatically and resiliently moving the impact panel assembly from the impacted position to the closed position, the resilience-producing means including a pair of resilient portions, each portion extending from a lower end portion of the impact panel structure to a corresponding bottom portion of the respective upright frame members.

2. The sectional overhead door assembly of claim 1, further comprising stop means operatively connected to the first and second upright frame members for preventing the impact panel structure from pivoting inwardly from the closed position.

3. The sectional overhead door assembly of claim 1, further comprising locking means for releasably locking the impact panel structure in the closed position.

4. The sectional overhead door assembly of claim 3, wherein the locking means includes a pair of slide lock assemblies secured to an inner side of the impact panel structure, each slide lock assembly being secured on opposite vertical sides of the impact panel structure and having a lock bar for releasable locking engagement with a corresponding upright frame member.

5. The sectional overhead door assembly of claim 1, wherein the first and second pivot means provide pivotal movement of the impact panel structure up to 90° from the closed position to the impacted position.

6. The sectional overhead door assembly of claim 1, wherein the impact panel structure includes a rigid internal support frame extending substantially around outer side portions of the impact panel structure, the internal support frame having an outer side and an inner side, an outer skin connected to the outer side of the internal support frame, and an inner skin formed of rigid high impact strength material secured in pressing engagement to the inner side of the internal support frame by a plurality of thermal expansion type fasteners.

7. The sectional overhead door assembly of claim 6, wherein each fastener has an enlarged head and a shaft having a plurality of outwardly projecting surfaces, the internal support frame having holes sized for receiving the shafts of the fasteners with the outwardly projecting surfaces engaging the holes to secure the fasteners in place, the inner skin having expansion holes for extension of the shafts therethrough, the expansion holes being sized to allow the inner skin to remain free of engagement with the shafts of the fasteners, the enlarged head of each fastener in pressing engagement with an outer surface of the inner skin.

8. The sectional overhead door assembly of claim 7, wherein the rigid high impact strength material is formed of ABS plastic.

9. The sectional overhead door assembly of claim 1, wherein the resilient portions are formed of an elastic cord having a first end secured to the bottom portion of the first upright frame member, the elastic cord extending through the lower horizontally extending portion of the impact panel structure from the first lower end portion to a second lower end portion, and a second end of the elastic cord being secured to a bottom portion of the second upright frame member.

10. The sectional overhead door assembly of claim 1, further comprising a flexible lower seal secured to a lower edge portion of the impact panel structure and extending the entire length thereof for positioning in immediate adjacency with a ground surface when the impact panel structure is in the closed position.

11. The sectional overhead door assembly of claim 10, further comprising a flexible upper seal secured to an upper edge portion of the impact panel structure and extending substantially the entire length thereof for positioning in immediate adjacency with a lower edge portion of the adjacent door panel when the impact panel structure is in the closed position.

12. An impact panel assembly for use with a sectional overhead door comprising:

(a) a rigid impact panel structure;

(b) flame means pivotally connected with the impact panel structure on opposite vertical sides thereof with a pair of horizontal pivot members for supporting the impact panel structure and allowing the impact panel structure to pivot from the frame means from a closed position with the impact panel structure generally vertically oriented to an impacted position with a lower horizontally extending portion of the impact panel structure being outwardly extendible away from the frame means, the frame means having downwardly extending portions adapted for extending laterally adjacent to vertically oriented guide tracks, the downwardly extending portions being adapted for pivotal connection with an adjacent door panel, guide means extending laterally away from each said downwardly extending portion for guiding said frame means in said guide tracks; and (c) resilience-producing means operatively connected between the frame means the impact panel structure for automatically and resiliently moving the impact panel assembly from the impacted position to the closed position, the resilience-producing means including a pair of resilient portions, each portion extending from a lower end portion of the impact panel structure to a corresponding bottom portion of the respective downwardly extending portions.

13. The impact panel assembly of claim 12, further comprising stop means operatively connected to the frame means for preventing the impact panel structure from pivoting inwardly from the closed position.

14. The impact panel assembly of claim 13, further comprising locking means for releasably locking the impact panel structure in the closed position.

15. The sectional overhead door assembly of claim 14, wherein the locking means includes a pair of slide lock assemblies secured to an inner side of the impact panel structure, each slide lock assembly being secured on opposite vertical sides of the impact panel structure and having a lock bar for releasable locking engagement with the frame means.

16. The impact panel assembly of claim 12, wherein the resilient member is formed of an elastic cord having a first end secured to the bottom portion of the first upright frame member, the elastic cord extending through the lower horizontally extending portion of the impact panel structure from the first lower end portion to a second lower end portion, and a second end of the elastic cord being secured to a bottom portion of the second upright frame member.

17. The impact panel assembly of claim 12, further comprising a flexible lower seal secured to a lower edge portion of the impact panel structure and extending the entire length thereof for positioning in immediate adjacency with a ground surface when the impact panel structure is in the closed position, and a flexible upper seal secured to an upper edge portion of the impact panel structure and extending substantially the entire length thereof, the upper seal being positionable in immediate adjacency with a lower edge portion of an adjacent door panel of the overhead sectional door assembly when the impact panel structure is in the closed position.

18. The impact panel assembly of claim 12, wherein the impact panel structure includes a rigid internal support frame extending substantially around outer side portions of the impact panel structure, the internal support frame having an outer side and an inner side, an outer skin connected to the outer side of the internal support frame, and an inner skin formed of rigid high impact strength material secured in pressing engagement to the inner side of the internal support frame by a plurality of thermal expansion type fasteners.

19. The impact panel assembly of claim 18, wherein each fastener has an enlarged head and a shaft having a plurality outwardly projecting surfaces, the internal support frame having holes sized for receiving the shafts of the fasteners with the outwardly projecting surfaces engaging the holes to secure the fasteners in place, the inner skin having expansion holes for extension of the shafts therethrough, the expansion holes being sized to allow the inner skin to remain free of engagement with the shafts the fasteners, the enlarged head of each fastener in pressing engagement with an outer surface of the inner skin.

20. An impact panel assembly for use with a sectional overhead door comprising:

(a) a rigid impact panel structure;

(b) frame means, pivotally connected with the impact panel structure for supporting the impact panel structure and allowing the impact panel structure to pivot from the frame means from a closed position with the impact panel structure generally vertically oriented to an impacted position with a lower horizontally extending portion of the impact panel structure being outwardly extendible away from the frame means, the frame means including first and second upright frame members disposed in a spaced apart relationship adjacent opposite vertical sides of the impact panel structure, each of the first and second upright frame members being adapted for extending laterally adjacent to vertically oriented guide tracks and for pivotal connection with an adjacent door panel, guide means extending laterally away from each said first and second upright frame members for guiding said frame means in said guide tracks, the pivotal connection between the impact panel structure and the frame means being provided by first pivot means for pivotally connecting a first upper end portion of the impact panel structure to a top portion of the first upright frame member, and second pivot means for pivotally connecting a second upper end portion of the impact panel structure to a top portion of the second upright frame member, the first and second pivot means each including a horizontally extending pivot member disposed on a corresponding one of the opposite vertical sides of the impact panel structure providing pivotal movement up to 90° from the closed position;

(c) stop means operatively connected to the frame means for preventing the impact panel structure from pivoting inwardly from the closed position;

(d) locking means for releasably locking the impact panel structure in the closed position; and (e) resilience-producing means including resilient portions extending from a first lower end portion of the impact panel structure to a bottom portion of the first upright frame member and from a second lower end portion of the impact panel structure to a bottom portion of the second upright frame member for automatically and resiliently moving the impact panel assembly from the impacted position to the closed position.

21. The impact panel assembly of claim 20, wherein the resilient portions art formed of an elastic cord having a first end secured to the bottom portion of the first upright frame member, the elastic cord extending through the lower horizontally extending portion of the impact panel structure from the first lower and portion to the second lower end portion, and a second end of the elastic cord being secured to a bottom portion of the second upright frame member.

22. The impact panel assembly of claim 21, further comprising a flexible lower seal secured to a lower edge portion of the impact panel structure and extending the entire length thereof for positioning in immediate adjacency with a ground surface when the impact panel structure is in the closed position, and a flexible upper seal secured to an upper edge portion of the impact panel structure and extending substantially the entire length thereof, the upper seal being positionable in immediate adjacency with a lower edge portion of an adjacent panel of the overhead sectional door assembly when the impact panel structure is in the closed position.

23. The impact panel assembly of claim 20, wherein the impact panel structure includes a rigid internal support frame extending substantially around outer side portions of the impact panel structure, the internal support frame having an outer side and an inner side, an outer skin connected to the outer side of the internal support frame, an inner skin formed of rigid high impact strength material secured in pressing engagement to the inner side of the internal support frame by a plurality of thermal expansion type fasteners, each fastener having an enlarged head and a shaft having a plurality outwardly projecting surfaces, the internal support frame having holes sized for receiving the shafts of the fasteners with the outwardly projecting surfaces engaging the holes to secure the fasteners in place, the inner skin having expansion holes for extension of the shafts therethrough, the expansion holes being sized to allow the inner skin to remain free of engagement with the shafts the fasteners, the enlarged head of each fastener in pressing engagement with an outer surface of the inner skin.

24. An impact panel assembly for use with a sectional overhead door comprising:

(a) an impact panel structure including a rigid internal support frame extending substantially around the outer side portions of the impact panel structure, the internal support frame having an outer side and an inner side, an outer skin connected to the outer side of the internal support frame, an inner skin formed of rigid high impact strength material secured in pressing engagement to the inner side of the internal support frame by a plurality of thermal expansion type fasteners, each fastener having an enlarged head and a shaft having a plurality outwardly projecting surfaces, the internal support frame having holes sized for receiving the shafts of the fasteners with the outwardly projecting surfaces engaging the holes to secure the fasteners in place, the inner skin having expansion holes for extension of the shafts therethrough, the expansion holes being sized to allow the inner skin to remain free of engagement with the shafts the fasteners, the enlarged head of each fastener in pressing engagement with an outer surface of the inner skin;

(b) frame means pivotally connected with the impact panel structure on opposite vertical sides thereof with a pair of horizontally extending pivot members for supporting the impact panel structure and allowing the impact panel structure to pivot from the frame means from a closed position with the impact panel structure generally vertically oriented to an impacted position with a lower horizontally extending portion of the impact panel structure being outwardly extendible away from the frame means upon application of an impact force thereto, the frame means having downwardly extending portions adapted for extending laterally adjacent to vertically oriented guide tracks and for pivotal connection with an adjacent door panel, guide means extending laterally away from each said downwardly extending portion for guiding said frame means in said guide tracks; and (c) resilient portions extending from a first lower end portion of the impact panel structure to a bottom portion of one of the downwardly extending portions and from a second lower end portion of the impact panel structure to another of the downwardly extending portions for automatically and resiliently moving the impact panel assembly from the impacted position to the closed position.

25. The impact panel assembly of claim 24, wherein the rigid high impact strength material is formed of ABS plastic.

26. An impact resistant sectional overhead door assembly movable on parallel tracks comprising:

(a) a plurality of adjacent door panels lying within a common plane and oriented in stacked abutting fashion with respect to one another;

(b) a plurality of hinges connected to facing horizontal edge portions of adjacent door panels for providing flexible connection therebetween;

(c) a plurality of roller assemblies connected to the door panels, each roller assembly having a roller adapted for rotationally engaging one of the tracks for guiding the movement of the door assembly on the tracks; and (d) one of said door panels comprising a bottom impact panel assembly connected to an adjacent door panel by hinges, the bottom impact panel assembly comprising: a rigid impact panel structure; first and second upright frame members disposed in a spaced apart relationship adjacent opposite vertical sides of the impact panel structure, first pivot means for pivotally connecting a first upper end portion of the impact panel structure to a top portion of the first upright frame member, second pivot means for pivotally connecting a second upper end portion of the impact panel structure to a top portion of the second upright frame member, the first and second pivot means providing pivotal movement of the impact panel structure from a closed position with the impact panel structure generally coplanar with the first and second upright frame members to an impacted position with a lower horizontally extending portion of the impact panel structure being outwardly extendible, and resilience-producing means operatively connected to the impact panel structure for automatically and resiliently moving the impact panel assembly from the impacted position to the closed position, the resilience-producing means including a resilient member extending from a first lower end portion of the impact panel structure to a bottom portion of the first upright frame member, the resilient member being formed of an elastic cord having a first end secured to the bottom portion of the first upright frame member, the elastic cord extending through the lower horizontally extending portion of the impact panel structure from the first lower end portion to a second lower end portion, and a second end of the elastic cord being secured to a bottom portion of the second upright frame member.

27. An impact panel assembly for use with a sectional overhead door comprising:

(a) a rigid impact panel structure;

(b) frame means pivotally connected with the impact panel structure for supporting the impact panel structure and allowing the impact panel structure to pivot from the frame means from a closed position with the impact panel structure generally vertically oriented to an impacted position with a lower horizontally extending portion of the impact panel structure being outwardly extendible, the frame means including first and second upright flame members disposed in a spaced apart relationship adjacent opposites vertical sides of the impact panel structure; and (c) resilience-producing means operatively connected between the frame means and the impact panel structure for automatically and resiliently moving the impact panel assembly from the impacted position to the closed position, the resilience-producing means including a resilient member extending from a first lower end portion of the impact panel structure to a bottom portion of the first upright flame member, the resilient member being formed of an elastic cord having a first end secured to the bottom portion of the first upright frame member, the elastic cord extending through the lower horizontally extending portion of the impact panel structure from the first lower end portion to a second lower end portion, and a second end of the elastic cord being secured to a bottom portion of the second upright frame member.

* * * * *